US005858029A

United States Patent [19]

Oumar-Mahamat et al.

[11] Patent Number: 5,858,029

[45] Date of Patent: Jan. 12, 1999

[54] FRICTION REDUCING ADDITIVES FOR FUELS AND LUBRICANTS

[75] Inventors: Halou Oumar-Mahamat, Princeton; James Thomas Carey, Medford, both of N.J.

[73] Assignee: Mobil Oil Corporation, Fairfax, Va.

[21] Appl. No.: 959,744

[22] Filed: Oct. 28, 1997

Related U.S. Application Data

[60] Provisional application No. 60/035,326 Jan. 13, 1997.

[51] Int. Cl.[6] ..... C10L 1/18; C10L 1/22

[52] U.S. Cl. ..... 44/418; 44/434

[58] Field of Search ..... 44/386, 418, 424, 44/434

[56] References Cited

U.S. PATENT DOCUMENTS

| | | | |
|---|---|---|---|
| 4,280,916 | 7/1981 | Richards et al. . | |
| 4,406,803 | 9/1983 | Liston et al. . | |
| 4,512,903 | 4/1985 | Schlicht . | |
| 4,617,026 | 10/1986 | Shaub et al. . | |
| 4,741,848 | 5/1988 | Koch et al. . | |
| 4,789,493 | 12/1988 | Horodysky . | |
| 4,808,196 | 2/1989 | Horodysky . | |
| 4,867,752 | 9/1989 | Braid et al. . | |
| 5,004,478 | 4/1991 | Vogel et al. | 44/398 |
| 5,112,364 | 5/1992 | Rath et al. | 44/418 |
| 5,169,410 | 12/1992 | Wright | 44/415 |
| 5,637,121 | 6/1997 | Cherpeck | 44/418 |

FOREIGN PATENT DOCUMENTS

| | | |
|---|---|---|
| 3942860 | 6/1991 | Germany . |

*Primary Examiner*—Sharon Gibson
*Assistant Examiner*—Cephia D. Toomer
*Attorney, Agent, or Firm*—Lori F. Cuomo; Dennis P. Santini

[57] ABSTRACT

The invention provides certain hydroxyacetamides which have been prepared by reacting primary etheramines with hydroxycarboxylic acid, particularly etheramine glycolamide, and their use as friction reducing additives in fuels and lubes.

9 Claims, No Drawings

FRICTION REDUCING ADDITIVES FOR FUELS AND LUBRICANTS

This is an application under 35 USC §111 (a) of provisional application 60/035,326, filed on Jan. 13, 1997.

BACKGROUND OF THE INVENTION

This invention is directed to primary etheramines which have been reacted with hydroxycarboxylic acid to form hydroxyamides and the use of the resulting products as friction reducing additives in fuels and lubes. More particularly, it is directed to fuel and lubricating compositions and concentrates containing such friction reducing additives.

A major concern today is finding methods to reduce engine friction and fuel consumption in internal combustion engines which are safe for the environment and economically attractive. One means is to treat moving parts of such engines with lubricants containing friction reducing additives. Considerable work has been done in this area.

U.S. Pat. No. 4,617,026 discloses the use of monocarboxylic acid ester of trihydric alcohol, glycerol monooleate, as a friction reducing additive in fuels and lubricants promoting fuel economy in an internal combustion engine.

The use of fatty formamides is disclosed in U.S. Pat. Nos. 4,789,493; 4,808,196; and 4,867,752.

The use of fatty acid amides is disclosed in U.S. Pat. No. 4,280,916.

U.S. Pat. No. 4,406,803 discloses the use of alkane-1,2-diols in lubricants to improve fuel economy of an internal combustion engine.

U.S. Pat. No. 4,512,903 discloses amides prepared from mono or poly hydroxy substituted aliphatic monocarboxylic acids and primary or secondary amines which are useful as friction reducing agents.

Accordingly, it is an object of the present invention to provide a composition for reducing and/or preventing friction.

It is another object of the present invention to provide a method for reducing friction in the operation of an internal combustion engine.

SUMMARY OF THE INVENTION

The instant invention is directed to N-alkoxy-alkyl-hydroxyacetamides prepared via condensation of primary etheramines and hydroxycarboxylic acids which have been found to be effective friction reducing additives for fuels, particularly gasoline, fuel additive concentrates, lubricants and lubricant additive concentrates, with good high temperature decomposing cleanliness.

In accordance with the invention, there is provided a lubricant composition comprising a lubricating oil or grease prepared therefrom and a friction reducing amount of a non-borated reaction product obtained by reacting $$R_1(OR_2)_aNH_2$$

wherein $R_1$ is hydrocarbyl or $C_1$ to $C_{60}$ alkyl,
$R_2$ is $C_1$ to $C_4$ alkylene,
a is 1 to 12,
and hydroxycarboxylic acid.

There is further provided a fuel composition comprising an internal combustion engine fuel and a friction reducing amount of a non-borated product obtained by reacting $$R_1(OR_2)_aNH_2$$

wherein $R_1$ is hydrocarbyl or $C_1$ to $C_{60}$ alkyl,
$R_2$ is $C_1$ to $C_4$ alkylene,
a is 1 to 12,
and hydroxycarboxylic acid.

There is still further provided a method for reducing and/or preventing friction in the operation of an internal combustion engine which comprises fueling said engine with a liquid fuel composition comprising per 1000 barrels of fuel between about 25 to about 250 pounds of a non-borated product obtained by reacting $$R_1(OR_2)_aNH_2$$

wherein $R_1$ is hydrocarbyl or $C_1$ to $C_{60}$ alkyl,
$R_2$ is $C_1$ to $C_4$ alkylene,
a is 1 to 12,
and hydroxycarboxylic acid.

DETAILED DESCRIPTION OF THE INVENTION

Reaction products of hydroxycarboxylic acids and primary etheramines have been found to have excellent friction reduction properties coupled with excellent high temperature cleanliness and decomposition features necessary for use in high quality fuels and lubricants for internal combustion engines. These compounds are made by reaction of condensation of various primary etheramines with hydroxycarboxylic acids at reflux temperatures high enough to transform the initially formed ammonium salt into an amide.

Primary etheramines useful in the preparation of N-alkoxy-alkyl-hydroxyacetamides are the primary etheramines of the formula:

$$R_1(OR_2)_aNH_2$$

wherein $R_1$ is $C_1$ to $C_{60}$ alkyl, normally $C_4$ to $C_{20}$ alkyl, optionally with substituents such as aryl, alkylaryl; $R_2$ is $C_1$ to $C_4$ alkylene; a is 1 to 12, normally 1 to 4.

Suitable primary etheramines include $C_6$ to $C_{12}$ alkyloxypropyl amines or mixtures thereof. A preferred etheramine is a mixture of $C_6$–$C_{12}$ alkoxypropylamines. Advantages of the use of etheramines include low temperature fluidity and cleanliness.

In addition, the primary etheramines may be used in conjunction with alkylamines. Suitable alkylamines include pure saturated or unsaturated monoamines and/or diamines or mixtures of alkylamines derived from fatty acids, such as coco, oleyl or tallow.

The primary etheramines and alkylamines can also contain heteroatoms such as oxygen, sulfur or nitrogen in their alkyl chains. The alkyl groups on the amines are long enough to confer friction reduction properties but not too long to prevent the inherent waxiness of long chain paraffins. However, the waxiness may be minimized by introducing a site of unsaturation or a heteroatom into the alkyl chain.

Suitable hydroxycarboxylic acids include alpha-hydroxycarboxylic acids, such as glycolic acid (hydroxyacetic acid) and lactic acid (alpha-hydroxypropionic acid), and dihydroxyalkylcarboxylic acids, such as 2,2-dihydroxyalkylpropionic acids and more particularly 2,2-dihydroxymethylpropionic acid. Glycolic acid is preferred.

The acids used can be pure or in solution. For example, the glycolic acid may be pure solid or a 70% solution in water. The lactic acid may be a 85% solution in water. In the case of solutions, the excess water has to be discounted in molar calculation of water so as to determine the completion of the reaction.

Hydrocarbon solvents or other inert solvents may be used in the reaction. Included among useful solvents are benzene, toluene, xylenes and higher boiling aromatic solvents, such as Aromatic 100, Aromatic 150 and the like. When solvent is used, the preferred solvent is xylenes. In general, any hydrocarbon solvent can be used in which the reactants and products are soluble and which can be easily removed.

A constant azeotropic removal with solvent of the water formed during the reaction may be performed using a moisture trap (Dean-Stark apparatus). In some cases, the solvent may be stripped off by continuous heating and completed by applying a low vacuum (10–20 mm/Hg) after the expected quantity of water is removed. In others, the solvent may be kept in the final mixtures to improve their fluidity.

The condensation reaction generally proceeds as follows:

$$R_1(OR_2)_aNH_2+HOCOR_3OH \rightarrow R_1(OR_2)_aNHCOR_3OH$$

wherein $R_1$ is hydrocarbyl, $C_1$ to $C_{60}$ alkyl, optionally containing sulfur, oxygen and/or nitrogen, aryl, alkylaryl, cycloalkyl, preferably $C_4$ to $C_{20}$, optionally with substituents such as aryl, alkylaryl, cycloalkyl; $R_2$ is $C_1$ to $C_4$ alkylene; $R_3$ is $C_1$ to $C_4$ alkylene or substituted alkylene, aryl, alkylaryl or cycloalkyl; a is 1 to 12, normally 1 to 4.

Generally the reaction temperature is in the range of from about 100° C. to about 175° C. and preferably in the range of from about 145° C. to about 165° C. The reaction time is generally in the range of from about 3 to about 24 hours and preferably in the range of from about 4 to about 8 hours.

It is preferred to use stoichiometric quantities of amines and acids. However, excess of one or another reagents can be desirable.

The amount of friction reducing additive in the lubricant composition may range from about 0.1 to about 10% by weight of the total lubricant composition. Preferred is from about 0.1 to about 2.0 wt. %.

In the lubricant additive concentrate the amount of friction reducing additive may range from about 1.0% to about 50.0% by weight of the total lubricant additive concentrate. Preferred is from about 10% to about 30% by weight.

The lubricant composition and/or the lubricant additive concentrate may contain other materials normally present in additive packages including dispersants, detergents, antioxidants, antiwear and extreme pressure agents, viscosity index improvers; corrosion inhibitors, anti-rust additives, antifoam agents, pour point depressants, various markers, taggants, and any solubilizing agents, such as oils, polymers, solvents and the like. These materials impart their customary properties to the particular compositions and do not detract from the value of the compositions into which they are incorporated.

Suitable dispersants include polyalkylene succinimides, Mannich bases, polyethers, polyalkylene amines, various esters and the like.

Suitable detergents include metallic and/or non-metallic phenates, sulfonates, carboxylates, and the like.

Suitable antioxidants include hindered phenols, arylated amines, sulfurized olefins and the like.

Suitable viscosity index improvers include polymethacrylates, olefin copolymers and the like.

Suitable antiwear and extreme pressure agents include zinc dialkyl dithiophosphates, dithiocarbamates, thiodiazoles, and the like.

Generally the total amount of all such other materials will not exceed about 10.0 to 30.0 wt. % in the lube compositions and about 10.0 to about 100.0% of the lube additive concentrates.

Furthermore, the lubricants contemplated for use herein include both mineral and synthetic hydrocarbon oils of lubricating viscosity, mixtures of mineral and synthetic oils and greases prepared therefrom, and other solid lubricants. The synthetic oils may include polyalphaolefins; polyalkylene glycols, such as polypropylene glycol, polyethylene glycol, polybutylene glycol; esters, such as di(2-ethylhexyl) sebacate, dibutyl phthalate, neopentyl esters, such as pentaerythritol esters, trimethylol propane esters; polyisobutylenes; polyphenyls; ethers such as phenoxy phenylethers; fluorocarbons; siloxanes; silicones; silanes and silicate esters; hydrogenated mineral oils or mixtures thereof.

The present invention may also be used in fuels such as gasoline, oxygenated gasolines, reformulated gasolines, gasohols, hydrocarbon fuels, mixed hydrocarbon and oxygenated fuels, jet turbine engine fuels and diesel fuels. The present invention may also be used in fuel additive concentrates.

Fuel compositions can contain from about 10 to about 1,000 pounds of friction reducing additive per 1,000 barrels of fuel or more preferably from about 25 to about 250 pounds per 1,000 barrels of fuel.

In the fuel additive concentrate the amount of friction reducing additive may range from about 1.0% to about 50.0% by weight of the total fuel additive concentrate. Preferred is from about 10% to about 30% by weight.

Fuel and fuel additive concentrates may contain other materials normally present in fuel additive packages including deposit control additives for carburetors, port fuel injectors, intake ports, intake valves, and combustion chambers; carrier fluids; anti-knock agents, such as tetraalkyl lead compounds, organomanganese compounds, lead scavengers, octane enhancing additives, and the like; dyes; markers; taggants; cetane improvers, such as alkyl nitrates, alkyl peroxides, and the like; antioxidants, such as hindered phenols, arylated amines, sulfurized olefins, and the like; rust inhibitors; demulsifiers; bacteriastatic agents; gum inhibitors; anti-icing agents; metal deactivators; exhaust valve anti-recession agents; spark enhancing additives; low temperature solubilizers; solvents necessary for low temperature performances or mixtures thereof.

Suitable demulsifiers include oxyalkylated alkylphenolic (formaldehyde) resins, and polyoxyalkylene glycols.

Suitable carrier fluids include mineral and/or synthetic oils, polyalkylenes, esters, polyols, polyethers or mixtures thereof.

Suitable corrosion inhibitors include alkyl lactic succinate esters.

The fuel and fuel additive concentrates generally comprise an effective amount of at least one detergent. The detergent is normally selected from the group consisting of polyalkyleneamines and Mannich base-type condensation products of hydrocarbyl phenols, aldehydes and amines. Generally, these detergent agents reduce and/or prevent deposits which have a tendency to form in carburetors and fuel injection systems, thereby improving engine performance. Such detergent agents also improve fuel economy and reduce internal combustion engine exhaust emissions.

The preferred polyalkyleneamine detergents are selected from the group consisting of polymeric 1-amines, including polyisobutylene-amines. High vinylic content polyisobutylene-amines are most preferred. Suitable polyisobutylene-amines are described in U.S. Pat. Nos. 5,004,478 and 5,112,364, and DE 3942860, the disclosures of which are incorporated herein in their entirety. Preferred polyisobutylene-amines have an average molecular weight of about 500 to about 3,000 or greater.

Such polyalkyleneamines are available from normal commercial sources or may be prepared by the amination of high vinylic content polyolefins having an average molecular weight of from about 500 to about 3000 or greater, using methods which are well known to those skilled in the art. Polyisobutylene amines are generally prepared by chlorination or hydroformylation of reactive polyisobutylene and subsequent amination with ammonia, hydrocarbyl amines, hydrocarbyl diamines, hydrocarbyl polyamines, alkoxylated hydrocarbyl amines, or mixtures thereof. Ammonia, ethylenediamine, diethylenetriamine, triethylenetetramine, tetraethylenepentamine, piperazines, hexamethylenediamine, hydroxyalkyl ethylenediamines, hydroxyalkyl triethylenetetraamines, and the like can be incorporated into the polyalkeneamines. Such amines can be prepared by the chlorination or halogenation of appropriate polymeric olefins, and subsequently converted into corresponding polyalkene derivatives using these or other known methods of manufacture.

The amount of polyalkyleneamine in the fuel composition may be at least about 10 to about 200 pounds per 1,000 barrels of fuel and preferably at least about 40 to about 150 pounds per 1,000 barrels of fuel.

The amount of polyalkyleneamine in the fuel additive concentrate may be at least about 10 wt. %, preferably at least about 20 wt. %, and most preferably in the range of from about 25 to about 60 wt. %.

Alternatively, preferred detergent agents are the Mannich base condensation products of hydrocarbyl phenols, aldehydes, and amines. The hydrocarbon-substituted phenols are generally prepared by the alkylation of phenol or phenolics with hydrocarbyl groups having from 10 to 150 carbon atoms. For instance, long chain olefins or polymeric olefins such as propylene and polyisobutylene can be used in the phenol alkylation step. The substituted phenol is then reacted with a carbonyl source and an amine. Carbonyl sources include aldehydes, such as formaldehyde, acetaldehyde, propanal, butanal, and 2-ethylhexanal. In addition, aromatic aldehydes may be used to provide a carbonyl source. For instance, benzaldehyde, tolualdehyde, vanillin, salicylaldehyde, and cinnamaldehyde may be used. Polycarbonyl compounds, such as paraformaldehyde or glyoxal can also be used in some aspects of the invention.

Amines useful in the preparation of the Mannich base condensation product include primary or secondary amines and amides. Fatty amines, hydroxyl-containing amines, or polyamines, such as di-, tri-, tetra- and pentamines can be used in some aspects of the invention. For example, linear and cyclic $C_2$–$C_6$ alkylene di-, tri-, tetra- and pentamines, polyamines, and their substituted polyfunctional derivatives can be used. Substituted derivatives, as used herein, refer to substitution with substituents such as halo, hydroxy, alkoxy, nitro, thio, carbalkoxy and alkylthio substituents. Such Mannich base condensation products are available from normal commercial sources. Suitable Mannich base condensation products are described in U.S. Pat. No. 5,169,410, the disclosure of which is incorporated herein in its entirety.

The amount of Mannich base condensation product in the fuel composition may be at least about 10 to about 200 pounds per 1,000 barrels of fuel and preferably at least about 40 to about 150 pounds per 1,000 barrels of fuel.

The amount of Mannich base condensation product in the fuel additive concentrate may be at least about 10 wt. %, preferably at least about 20 wt. %, and most preferably in the range of from about 25 to about 60 wt. %.

A concentrate utilizing the friction reducing additive of the present invention typically also comprises about 15 to about 80% solvent. A preferred composition range is as follows:

| Component | Wt % Range |
|---|---|
| Hydroxyacetamide | 5 to 25 |
| Detergent | 20 to 60 |
| Solvent | |
| Isopropanol | 0 to 30 |
| Xylene | 15 to 50 |

Where the presently described invention is used as a gasoline additive, the additive package may be added at any point after the gasoline has been refined, i.e. the additive package can be added at the refinery or in the distribution system.

The invention also includes a method for reducing and/or preventing friction in the operation of an internal combustion engine. Additional possible benefits realized from the present invention include enhanced engine cleanliness, enhanced lubricity, enhanced corrosion protection, reduced fuel consumption, increased power benefits, and reduced wear. The method comprises delivering to the internal combustion engine a fuel comprising gasoline and a friction reducing additive, and other materials normally present in additive packages, described above.

The following examples are illustrative of the present invention.

EXAMPLE 1

Four hundred grams (2.0 moles) of a distilled fatty cocoamine (Armed CD, commercially obtained from Akzo Chemicals, Inc.) and 152.0 grams (2.0 moles of pure powder) glycolic acid (commercially obtained from Aldrich Chemical Co.) in 500 ml of xylenes as solvent were heated at reflux (140° C.) for 3 hours under inert nitrogen atmosphere. The water formed during the reaction was constantly removed by azeotropic distillation with xylenes using a moisture trap. The solvent was then stripped by distillation at a temperature up to 160° C. for 20 minutes then under reduced pressure of 10–20 mm/Hg at 140° C. for 45 minutes. Five hundred eighty grams of white waxy solid was obtained.

EXAMPLE 2

Four hundred fourteen grams (2.0 moles) of an etheramine, $C_8$–$C_{10}$ alkoxypropylamine (Tomah PA1214, commercially obtained from Tomah Products, Inc.) and 216 grams (2.0 moles) of 70% glycolic acid aqueous solution (commercially obtained from Aldrich Chemical Co.) in 111 grams of xylenes were heated at reflux (up to 150° C.) for a total of 4 hours under inert nitrogen atmosphere. The water from the glycolic acid solution and that formed during the reaction was constantly removed by azeotropic distillation using a moisture trap. Five hundred grams of light brown liquid, approximately 80% active in xylenes, was obtained.

EXAMPLE 3

Two hundred forty six grams (2.29 moles) of 70% glycolic acid aqueous solution (commercially obtained from Aldrich Chemical Co.) and a mixture of 402 grams (1.92 moles) of an etheramine, $C_8$–$C_{10}$ alkoxypropylamine (Tomah PA1214, commercially obtained from Tomah Products, Inc.) and 100 grams (0.37 mole) of tallowamine (Armeen HT, commercially obtained from Akzo Chemicals, Inc.) in 130 grams of xylenes were heated at reflux (up to 150° C.) for a total of 7 hours under inert nitrogen atmosphere. The water from the glycolic acid solution and that formed during the reaction was constantly removed by azeotropic distillation with xylenes using a moisture trap. Seven hundred twenty-four grams of a light brown white solid, approximately 80% active in xylenes, was obtained.

EXAMPLE 4

Three hundred thirteen grams (1.5 moles) of an etheramine, $C_8$–$C_{10}$ alkoxypropylamine (Tomah PA1214, commercially obtained from Tomah Products, Inc.) and 159 grams (1.5 moles) of 85% DL-lactic acid aqueous solution (commercially obtained from Aldrich Chemical Co.) in 97 grams of xylenes were heated at reflux (up to 150° C.) for a total of 4 hours under inert nitrogen atmosphere. The water from the lactic acid solution and that formed during the reaction was constantly removed by azeotropic distillation using a moisture trap. Five hundred sixteen grams of clear brown liquid, approximately 80% active in xylenes, was obtained.

EXAMPLE 5

Four hundred nineteen grams (2.02 moles) of an etheramine, $C_8$–$C_{10}$ alkoxypropylamine, (Tomah PA1214, commercially obtained from Tomah Products, Inc.) and 2,2-dihydroxymethylpropionic acid (commercially obtained from Aldrich Chemical Company, Inc.) (269 grams, 1.97 moles) in 130 grams of xylenes as solvent were heated at reflux for a total of 7 hours under inert nitrogen atmosphere. The water resulting from the reaction was constantly removed by azeotropic distillation with xylenes using a moisture trap. About 650 grams of a yellowish liquid approximately 80% active in xylenes, was obtained.

EXAMPLE 6

One hundred thirty-seven grams (0.5 moles) of a fatty liquid oleylamine (Armeen OL, commercially obtained from Akzo Chemicals, Inc.) and a 70% glycolic acid aqueous solution (commercially obtained from Aldrich Chemical Co.) (54 grams, 0.5 moles added gradually during the first 2 hours of reaction) in 150 ml of xylenes as solvent were heated at reflux (up to 150° C. for a total of 3 hours under inert nitrogen atmosphere. The water from the glycolic acid solution and that formed during the reaction was constantly removed by azeotropic distillation with xylenes using a moisture trap. The solvent was then stripped by distillation at a temperature up to 160° C. for 20 minutes then under reduced pressure of 10–20 mm/Hg at 140° C. for 45 minutes. One hundred fifty-two grams of dark brown solid was obtained.

The friction reducing properties of the products in the examples were measured using LVFA (Low Velocity Friction Apparatus) test and/or a Buick 3.8 L Fired Engine test. The additives were dissolved at 1.00 or 0.50 or 0.25 wt. % into a fully formulated 5W-30 mineral engine oil used as reference.

In the LVFA test, the coefficients of friction of the reference oil and the oils containing the products of this invention were measured at 32, 38, 48 and 58 psi over a range of sliding speeds (5–30 ft/min.) at both room temperature and 250° F. and averaged. The percent changes in the coefficients of friction of the test oils relative to the reference oil are reported in Table 1 below. Also reported and used as reference are the results of a commercially available friction modifier, glycerol monooleate (GMO). The larger the percent reduction in the coefficient of friction; the effectiveness of the additive is increased. The etheramine glycolamide of Example 2 is superior to the oleylglycolamide additive of Example 6 and GMO in friction reduction.

TABLE 1

Change in the Coefficients of Friction

| | Treat Rate | Coefficients of Friction % Reduction | |
|---|---|---|---|
| Example | wt.% | Static | Dynamic |
| 1 | 0.5 | 26.9 | 18.5 |
| 2 | 0.5 | 35.9 | 18.7 |
| 6 | 0.5 | 23.1 | 12.0 |
| GMO | 0.5 | 7.0 | 4.0 |

A 3.8 L Fired Engine test measures brake specific fuel consumption (BSFC) for each sample and the results are compared to those of the unadditized engine oil used as reference.

The experiments are generally additive spike additions to the lubricating oil of the engine run at a high temperature of 275° F. In some cases, a lower temperature of 225° F. was used to simulate typical water cooled engine running temperatures.

The percent reduction in fuel consumption results reported in Table 2 below are percent improvement over the reference oil. The larger the percent reduction in BSFC; the more effective is the additive. Here also, GMO (glycerol monooleate) results were used as reference for comparative reasons. Despite good percent friction reduction, the additive prepared via condensation of cocoamine and glycolic acid of Example 1 is not soluble at 1.0 wt. % in the test oil.

TABLE 2

Reduction in Fuel Consumption

| | Treat Rate | % Reduction in Fuel Consumption | |
|---|---|---|---|
| Example | wt % | 225° F. | 275° F. |
| 1 | 1 | — | 9.9 |
| 2 | 1 | 7.4 | 9.7 |
| | 0.5 | 7.0 | 5.3 |
| | 0.25 | 3.7 | −0.2* |
| 3 | 1 | 7.1 | 9.6 |
| | 0.5 | 7.3 | 7.8 |
| | 0.25 | 5.2 | 0.6 |
| 5 | 1 | 6.9 | 7.7 |
| | 0.5 | 6.2 | 0.0* |
| | 0.25 | 3.5 | −0.5* |
| GMO | 1 | —* | 2.0 |

*No response

As can be seen from the low velocity friction apparatus test results and also from the 3.8 L Fired Engine test results, the products of this invention show exceptional friction reduction properties leading to enhanced fuel economy and better performance than the commercially available friction modifier additive, glycerol monooleate. Unprecedented fuel consumption benefits close to 10% were observed at treat level as low as 1.00 wt. %. Moreover, good fuel economy benefits were observed at 0.25 wt. %, demonstrating the high efficiency of some of the products of this invention.

The products of the examples were also evaluated with respect to cleanliness during thermal decomposition using TGA (Thermogravimetric Analysis) and the results are compared to a commercially available friction modifier, glycerol monooleate (GMO) as shown in Table 3 below. Thermogravimetric analysis was performed by heating a small sample at 20° C./min. with an air flow of 100 ml/min. using a Thermogravimetric Analyzer. The percent residue remaining at 425° C. was recorded; little or no residue is desirable.

TABLE 3

| Cleanliness | |
|---|---|
| Example | Thermogravimetric Analysis % Residue @ 424° C. |
| 1 | 3.6 |
| 2 | 3.5 |
| 3 | 5.4 |
| 4 | 1.0 |
| 5 | 2.3 |
| 6 | 13.1 |
| GMO | 25.0 |

As can be seen from the thermogravimetric analysis results in Table 3, the products of this invention show exceptionally higher cleanliness than the commercially available friction modifier, GMO. The etheramine glycolamide of Examples 2, 3, 4 and 5 is superior to the oleylglycolamide of Example 6 and GMO in cleanliness.

The results of the LVFA, 3.8 L Fired Engine test and TGA shown in the above Tables show the superiority of the products of the present invention over the glycerol monooleate as friction reducers as well as in the cleanliness of decomposition. It is also believed that the additional groups on the amides such as hydroxyl, amino, imino and alkoxy contributes to better surface activity in synergy with the amide function.

EXAMPLE 7

Using the reaction product of Example 2, the following fuel additive concentrate formulations are prepared.

| Formulation | A | B | C | D | E | F |
|---|---|---|---|---|---|---|
| Component (Wt. % Range) Example 2 reaction product | 15.0 | 14.88 | 22.7 | 19.46 | 29.7 | 10.0 |
| Detergent | | | | | | |
| Mannich-base condensation product (Ethyl 4961M) | | 30.12 | 47.3 | | 40.3 | 45.0 |
| Polyisobutylene amine (Pluradyne AP-92M) | 30.0 | | | 40.54 | | |
| Solvent | | | | | | |
| Isopropanol | 18.33 | 18.33 | 10.0 | 13.33 | 10.0 | 8.0 |
| Xylene | 36.67 | 36.67 | 20.0 | 26.67 | 20.0 | 37.0 |

EXAMPLE 8

Using the reaction product of Example 4, the following fuel additive concentrate formulations are prepared:

| Formulation | A | B | C | D | E | F |
|---|---|---|---|---|---|---|
| Component (Wt. % Range) Example 4 reaction product | 15.0 | 14.88 | 22.7 | 19.46 | 29.7 | 10.0 |

-continued

| Formulation | A | B | C | D | E | F |
|---|---|---|---|---|---|---|
| Detergent | | | | | | |
| Mannich-base condensation product (Ethyl 4961 M) | | 30.12 | 47.3 | | 40.3 | 45.0 |
| Polyisobutylene amine (Pluradyne AP-92M) | 30.0 | | | 40.54 | | |
| Solvent | | | | | | |
| Isopropanol | 18.33 | 18.33 | 10.0 | 13.33 | 10.0 | 8.0 |
| Xylene | 36.67 | 36.67 | 20.0 | 26.67 | 20.0 | 37.0 |

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A fuel composition comprising an internal combustion engine fuel and a friction reducing amount of a non-borated product obtained by reacting $$R_1(OR_2)_aNH_2$$

wherein $R_1$ is $C_1$ to $C_{60}$ alkyl,
$R_2$ is $C_1$ to $C_4$ alkylene,
a is 1 to 12,
and a hydroxycarboxylic acid selected from the group consisting of hydroxy($C_1$–$C_4$)alkylcarboxylic acids and dihydroxyalkylcarboxylic acids.

2. The fuel composition of claim 1, wherein $R_1$ is $C_8$ to $C_{10}$ alkyl, $R_2$ is $C_3$ alkylene, a is 1, and said hydroxycarboxylic acid is glycolic acid.

3. The fuel composition of claim 1, further comprising a detergent selected from the group consisting of polalkyleneamines and Mannich base condensation products.

4. The fuel composition of claim 1, further comprising a demulsifier.

5. The fuel composition of claim 1, wherein the internal combustion engine fuel is selected from the group consisting of hydrocarbons, alcohols, oxygenated hydrocarbons and mixtures thereof.

6. A fuel additive concentrate comprising a friction reducing amount of a non-borated reaction product of the following formula $$R_1(OR_2)_aNHCOR_3OH$$

wherein $R_1$ is hydrocarbyl or $C_1$ to C60 alkyl,
$R_2$ is $C_1$ to $C_4$ alkylene,
$R_3$ is $C_1$ to $C_4$ alkylene or substituted alkylene or cycloalkyl,
a is 1 to 12,
and at least one detergent.

7. A method for reducing and/or preventing friction in the operation of an internal combustion engine which comprises fueling said engine with a liquid fuel composition comprising per 1000 barrels of fuel between about 25 to about 250 pounds of a non-borated product obtained by reacting $$R_1(OR_2)_aNH_2$$

wherein $R_1$ is hydrocarbyl or $C_1$ to $C_{60}$ alkyl, $R_2$ is $C_1$ to $C_4$ alkylene, a is 1 to 12, and a hydroxycarboxylic acid selected from the group consisting of hydroxy($C_1$–$C_4$)alkylcarboxylic acids and dihydroxyalkylcarboxylic acids.

8. The fuel composition of claim 1, wherein said hydroxycarboxylic acid is an alpha-hydroxycarboxylic acid.

9. The fuel composition of claim 5, wherein the hydrocarbons are distillate fuels or gasoline.

* * * * *

UNITED STATES PATENT AND TRADEMARK OFFICE

CERTIFICATE OF CORRECTION

PATENT NO. : 5,858,029

DATED : Janaury 12, 1999

INVENTOR(S) : Oumar-Mahamat et al.

It is certified that error appears in the above-identified patent and that said Letters Patent is hereby corrected as shown below:

In the Claims:

Claim 6, Column 10, line 53, "C60" should read ---$C_{60}$---.

Signed and Sealed this

Seventeenth Day of October, 2000

*Attest:*

Q. TODD DICKINSON

*Attesting Officer*

*Director of Patents and Trademarks*